US012358708B2

(12) United States Patent
Lin

(10) Patent No.: US 12,358,708 B2
(45) Date of Patent: Jul. 15, 2025

(54) MASK PACKAGE AND MASK CARRYING SYSTEM

(71) Applicant: DARWIN PRECISIONS CORPORATION, Hsinchu County (TW)

(72) Inventor: Cheng-Wei Lin, Hsinchu County (TW)

(73) Assignee: DARWIN PRECISIONS CORPORATION, Hsinchu County (TW)

( * ) Notice: Subject to any disclaimer, the term of this patent is extended or adjusted under 35 U.S.C. 154(b) by 0 days.

(21) Appl. No.: 18/226,271

(22) Filed: Jul. 26, 2023

(65) Prior Publication Data

US 2024/0294321 A1 Sep. 5, 2024

(30) Foreign Application Priority Data

Mar. 1, 2023 (TW) ..... 112107326

(51) Int. Cl.
*B65D 81/127* (2006.01)
*B65D 77/04* (2006.01)
*B65D 85/62* (2006.01)

(52) U.S. Cl.
CPC ..... *B65D 81/127* (2013.01); *B65D 77/0406* (2013.01); *B65D 85/62* (2013.01)

(58) Field of Classification Search
CPC ..... B65D 43/16; B65D 71/02; B65D 77/04; B65D 77/0406; B65D 81/05; B65D 81/127; B65D 85/38; B65D 85/62; B65D 85/86; C23C 14/04; C23C 14/24; H05B 33/10; H05B 33/14
See application file for complete search history.

(56) References Cited

FOREIGN PATENT DOCUMENTS

| | | | | |
|---|---|---|---|---|
| CN | 111453156 A | 7/2020 | | |
| CN | 114435754 A | 5/2022 | | |
| CN | 110318022 B | 6/2022 | | |
| JP | 2015018272 A | 1/2015 | | |
| TW | M360223 U1 | 7/2009 | | |
| TW | M415132 U1 | 11/2011 | | |
| WO | WO-2018061757 A1 * | 4/2018 | ..... | B32B 15/012 |
| WO | WO-2021066143 A1 * | 4/2021 | ..... | B65D 81/025 |

* cited by examiner

*Primary Examiner* — Bryon P Gehman

(57) ABSTRACT

A mask package comprises a package body, a cover body and a first buffer. The package body has a bottom and a side wall, where the side wall has a top; the side wall is connected with the bottom, the top is located on a side opposite to a side where the side wall is connected with the bottom, and the side wall surrounds the bottom to form an accommodating space. The cover body is disposed on the top of the side wall and masks the accommodating space. The first buffer has a first length and a first width, and is disposed between the package body and the cover body, where the accommodating space has a second length and a second width, the second length is less than the first length and the second width is less than the first width.

13 Claims, 6 Drawing Sheets

MASK PACKAGE AND MASK CARRYING SYSTEM

FIELD OF THE INVENTION

The present invention relates to the field of optical material packaging, and in particular to a packaging structure of a mask.

BACKGROUND OF THE INVENTION

Fine metal mask (FMM) is commonly used in the display industry, for example, in the manufacture of organic light-emitting diode (OLED) display panels, which is used to evaporate pixel materials onto a substrate to form pixel arrays. FMM is a high-cost metal sheet that is conventionally packaged for transportation. A general package includes an upper plate and a lower plate, and the FMM is sandwiched between the upper plate and the lower plate. However, this kind of packaging structure may squeeze the FMM, and it cannot prevent mask damage caused by movement or impact during transportation.

SUMMARY OF THE INVENTION

The present invention provides a mask package, which can provide anti-impact protection for contents such as a mask and avoid internal pressure caused by external stress transfer.

The present invention further provides a mask carrying system, in which the mask may be kept in its original state without damage.

The mask package provided by the present invention comprises a package body, a cover body and a first buffer. The package body has a bottom and a side wall, where the side wall has a top; the side wall is connected with the bottom, the top is located on a side opposite to a side where the side wall is connected with the bottom, and the side wall surrounds the bottom to form an accommodating space. The cover body is disposed on the top of the side wall and masks the accommodating space. The first buffer has a first length and a first width, and is disposed between the package body and the cover body, where the accommodating space has a second length and a second width, the second length is less than the first length and the second width is less than the first width.

The mask carrying system provided by the present invention includes the aforementioned mask package, at least one mask and a plurality of paper materials. The mask has a first surface and a second surface opposite to the first surface, and the mask is disposed on the first buffer and located in the accommodating space. The plurality of paper materials are disposed on the mask.

With the adoption of the package body having the accommodating space in the present invention, the mask can be prevented from being squeezed and the generation of shear stress can be avoided; and with the adoption of the package body and the first buffer, the anti-impact protection can be provided for the mask, and internal pressure caused by the transfer of external stress can be avoided.

Other objectives, features and advantages of the invention will be further understood from the further technological features disclosed by the embodiments of the invention wherein there are shown and described preferred embodiments of this invention, simply by way of illustration of modes best suited to carry out the invention.

DETAILED DESCRIPTION OF PREFERRED EMBODIMENTS

The foregoing and other technical contents and other features and advantages of the present invention will be clearly presented from the following detailed description of a preferred embodiment in cooperation with the accompanying drawings. Directional terms mentioned in the following examples, for example, upper, lower, left, right, front, back, top or bottom, are only used to describe directions referring to the attached drawings. Therefore, the directional terms used are for illustration and not for limitation.

Figure 1:
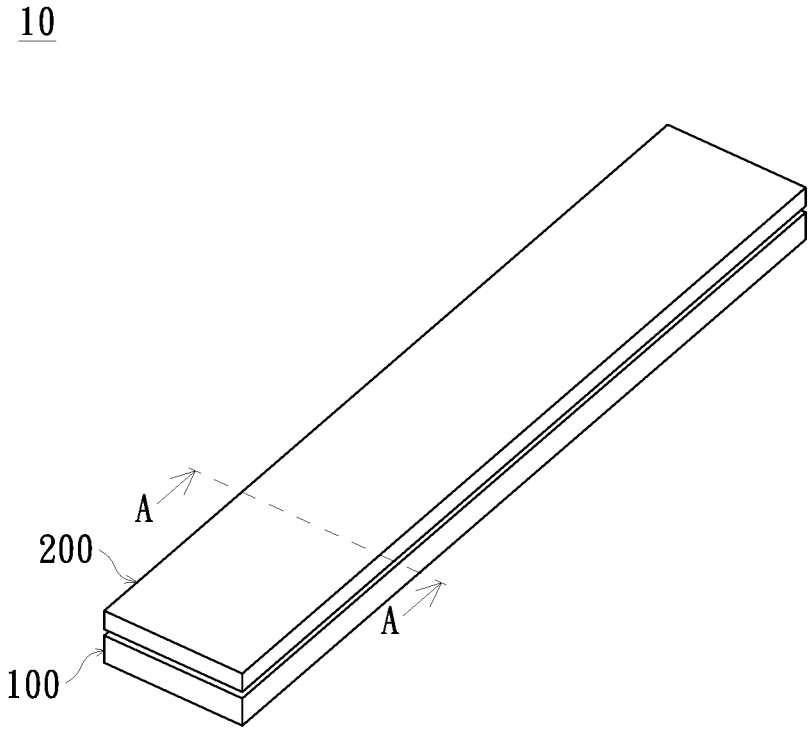
FIG. 1 is a schematic perspective view of a mask package according to an embodiment of the present invention.
Figure 2:
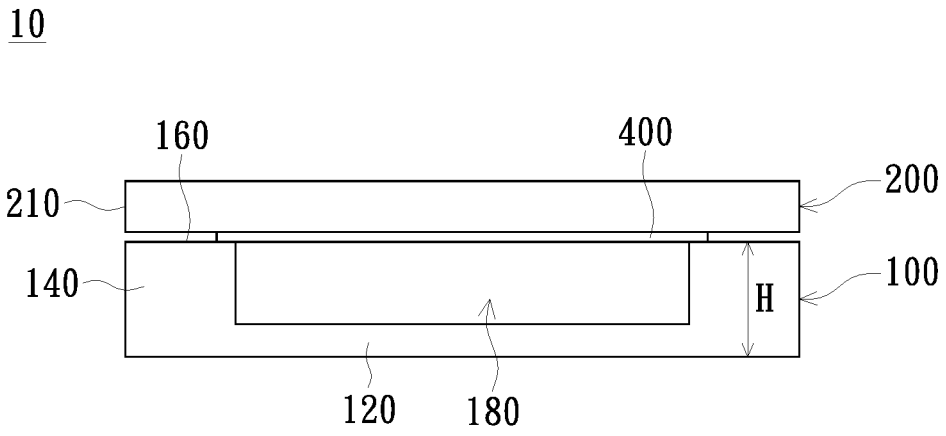
FIG. 2 is a schematic sectional view of the embodiment of FIG. 1.
Figure 3:
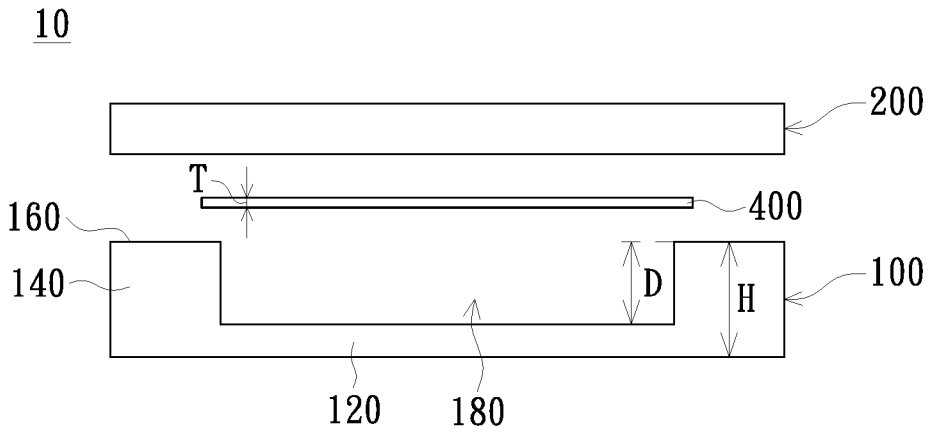
FIG. 3 is an exploded schematic sectional view of the embodiment of FIG. 1.

FIG. 1 is a schematic perspective view of a mask package according to an embodiment of the present invention, FIG. 2 is a schematic sectional view along a line AA of FIG. 1, and FIG. 3 is a schematic sectional view of the embodiment of FIG. 1 in an exploded state. In a preferred embodiment of the present invention, the mask package 10 substantially has a cuboid appearance. As shown in FIG. 1 to FIG. 3, the mask package 10 comprises a package body 100, a cover body 200 and a first buffer 400. The package body 100 has a bottom 120 and a side wall 140, where the side wall 140 is connected with the bottom 120, and the side wall 140 surrounds the bottom 120 to form an accommodating space 180. Preferably, the package body 100 is integrally formed, and the side wall 140 and the bottom 120 are integrally connected. A material of the package body 100 can be, for example, a strong and light polymer material (such as plastic), or a processed natural material (such as thick paper treated with paint), but is not limited thereto.

In an embodiment of the present invention, the bottom 120 preferably has a certain degree of thickness. The bottom 120 with the thickness, for example, helps to ensure the structural strength of the package body 100 and can provide sufficient protection for contents of the package. After deducting the thickness of the bottom 120 in a direction of a height H of the package body 100, a depth D of the accommodating space 180 can be obtained approximately, and a direction of the depth D is approximately parallel to the direction of the height H of the package body 100. In a preferred embodiment of the present invention, the depth D of the accommodating space 180 is preferably 20% to 50% of the height H of the package body 100. In addition, the accommodating space 180 is generally cuboid, but it is not limited thereto. The side wall 140 also preferably has an appropriate thickness. The side wall 140 with the appropriate thickness helps to provide more protection for the contents of the package, and a top 160 can be formed on a side opposite to a side where the side wall 140 is connected with the bottom 120.

As shown in FIG. 1 to FIG. 3, the cover body 200 is disposed on the top 160 of the side wall 140, and as shown in FIG. 2, the cover body 200 masks the accommodating space 180. Based on the appropriate thickness of the side wall 140, the top 160 can support the cover body 200 on the package body 100. In an embodiment of the present invention, a length and a width of the cover body 200 can be approximately the same as those of the package body 100, so that when the cover body 200 is combined with the package body 100, side margins 210 of the cover body 200 can be approximately aligned with side edges of the package body 100. However, the length and the width of the cover body 200 are not limited to being the same as those of the package body 100. In more detail, the length, the width and a thickness of the cover body 200 are similar to those of the package body 100, but are not limited thereto. In some embodiments, the thickness of the cover body 200 and the thickness of the package body 100 have to be greater than 5 mm in order to maintain the structural strength of the mask package 10.

The mask package 10 also includes a buffer. As shown in FIG. 2 to FIG. 3, the buffer includes a first buffer 400 disposed between the package body 100 and the cover body 200. In a preferred embodiment of the present invention, the first buffer 400 is a sheet and has a thickness T, and the thickness T can be, for example, 1% to 10% of the depth D. The first buffer 400 can have a first length L1 and a first width W1, and a direction of the first length L1 and a direction of the first width W1 are perpendicular to each other. In a preferred embodiment of the present invention, the first buffer 400 can be substantially rectangular or flat cuboid, and the first length L1 and the first width W1 respectively represent a length and a width of a rectangle; however, the first buffer 400 is not limited to a rectangle. In another aspect, the accommodating space 180 has a second length L2 and a second width W2. A direction of the second length L2 and a direction of the second width W2 are preferably perpendicular to each other, too, and the second length L2 is less than the first length L1 and the second width W2 is less than the first width W1. In a preferred embodiment of the present invention, the first length L1 is 110% to 130% of the second length L2, and the first width W1 is 110% to 120% of the second width W2.

Figure 4:
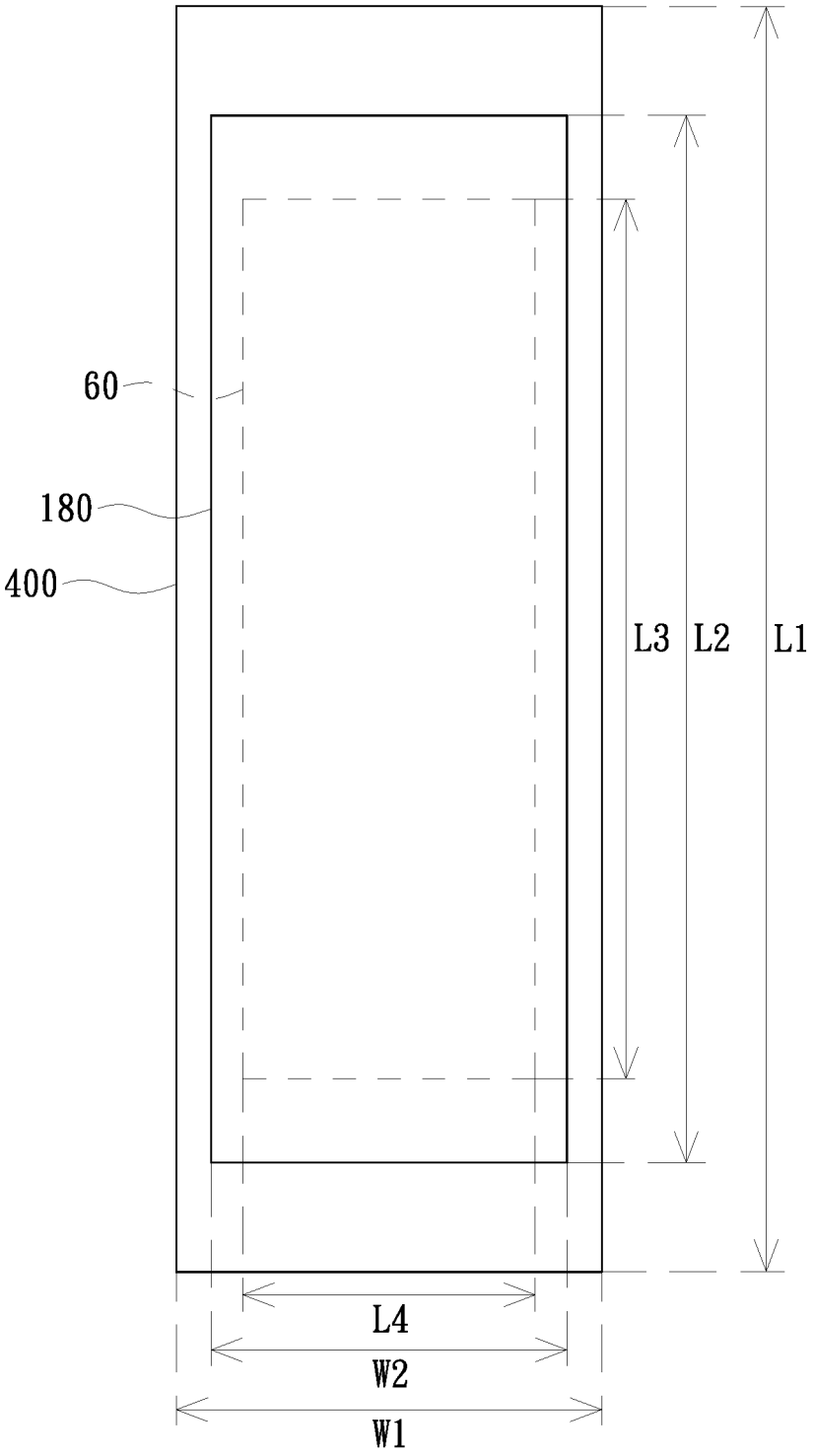
FIG. 4 is a schematic diagram showing length/width comparison between an accommodating space and a first buffer according to an embodiment of the present invention.

FIG. 4 is a schematic diagram showing length/width comparison between the accommodating space and the first buffer. A viewing angle of FIG. 4 can be an angle of looking down at the first buffer 400 and the package body 100. As shown in FIG. 4, the first buffer 400 can be disposed on the package body 100 in such a way that edges with the first lengths L1 correspond to edges with the second lengths L2 of the accommodating space 180 and edges with the first widths W1 correspond to edges with the second widths W2 of the accommodating space 180. Since the first length L1 is greater than the second length L2 and the first width W1 is greater than the second width W2, the first buffer 400 can cover the accommodating space 180, and a periphery of the first buffer 400 can be laid on the top 160.

The first buffer 400 is preferably supportive, elastic and extensible. Without external force, as shown in FIG. 3, the first buffer 400 is generally unfolded and flat; however, it has a potential to be flexed under stress. A material of the first buffer 400 can be a polymer material such as plastic. In several embodiments of the present invention, for example, the material of the first buffer 400 can be polypropylene plastics.

The first buffer 400 can be used to hold articles, such as a mask, so as to package the mask into the package 10. When the first buffer 400 bears an object with a sufficient weight, such as a sufficient number of masks, the first buffer 400 can be bent in accordance with the direction of the weight. However, it can be known that the first buffer 400 also supports the loaded object. In this way, according to the embodiment of the present invention, the rigid package body 100 is used to accommodate the articles, and the flexible first buffer 400 is lined between the articles and the package body 100, so that the anti-impact protection can be provided for the contents such as the mask, and the internal pressure caused by external stress transfer can be avoided, thereby avoiding a situation that the contents such as the mask are bent or damaged due to pressure.

Figure 5:
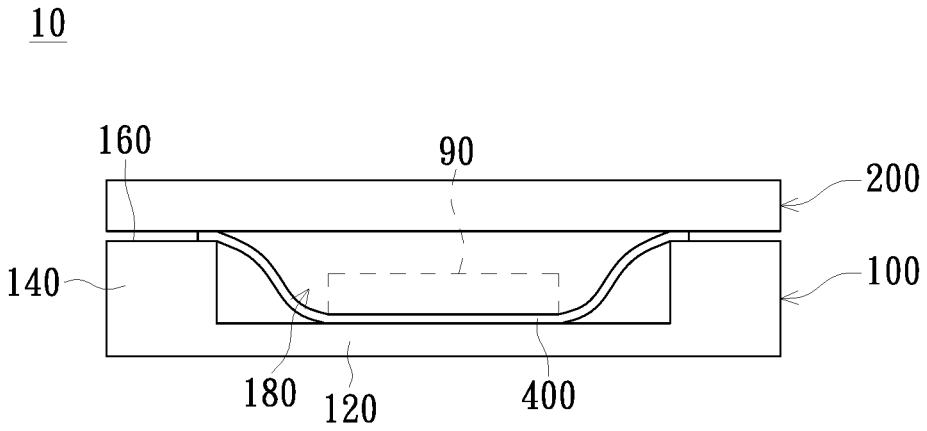
FIG. 5 is another schematic sectional view of the embodiment of FIG. 1.

Further refer to FIG. 5. FIG. 5 shows what may happen to the first buffer 400 when the loaded object 90 has a sufficient weight. As shown in FIG. 5, the first buffer 400 can be bent and further enter the accommodating space 180. A portion of the periphery can extend out of the accommodating space 180, and be laid on the top 160 of the side wall 140. The first buffer 400 shown in FIG. 5 further touches the bottom 120, but the present invention is not limited thereto. For example, if the loaded object 90 is light, the first buffer 400 may not touch the bottom 120. In several embodiments, the mask package 10 can further comprise a glue material that is disposed between the first buffer 400 and the package body 100 and glues the first buffer 400 and the package body 100.

Figure 6:
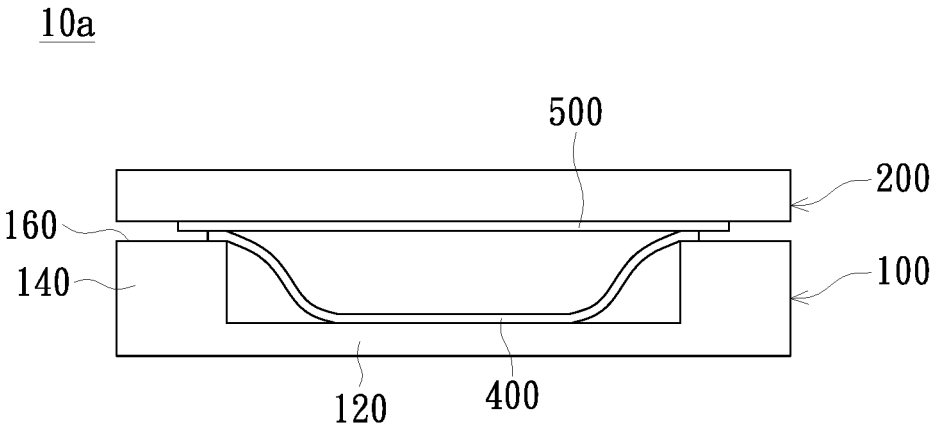
FIG. 6 is a schematic sectional view of a mask package according to another embodiment of the present invention.

FIG. 6 is a schematic sectional view of a mask package according to another embodiment of the present invention. This embodiment differs from the previous embodiment in that the buffer further includes a second buffer 500 disposed between the first buffer 400 and the cover body 200. The second buffer 500 can be substantially the same as or similar to the first buffer 400 in terms of materials and sizes, and the second buffer 500 is preferably used to cover the contents. Further, the second buffer 500 and the first buffer 400 can coat the mask from upper and lower sides of the contents, such as the mask, respectively, into the package 10*a*.

Figure 7:
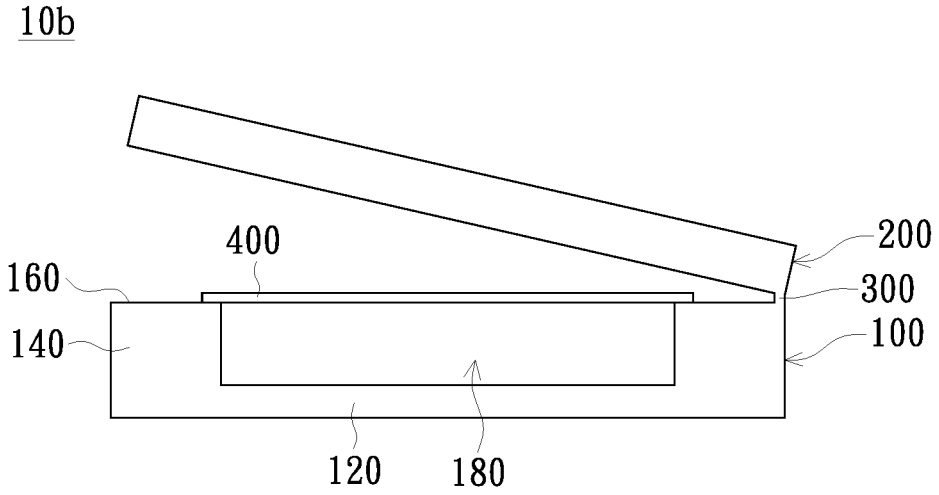
FIG. 7 is a schematic sectional view of a mask package according to still another embodiment of the present invention.

FIG. 7 is a schematic sectional view of a mask package according to another embodiment of the present invention. This embodiment differs from the previous embodiment in that the cover body 200 is connected with the package body 100 and a pivot part 300 is formed therebetween, and the cover body 200 is adapted to rotate relative to the package body 100 with the pivot part 300 as an axis. Preferably, the mask package 10*b* is integrally formed, and the cover body 200 and the package body 100 are integrally connected. In this embodiment, since the cover body 200 is connected with the package body 100, a reinforcing structure can be formed at side edges of the mask package 10*b*. In addition, the second buffer 500 can also be used in this embodiment.

Figure 8:
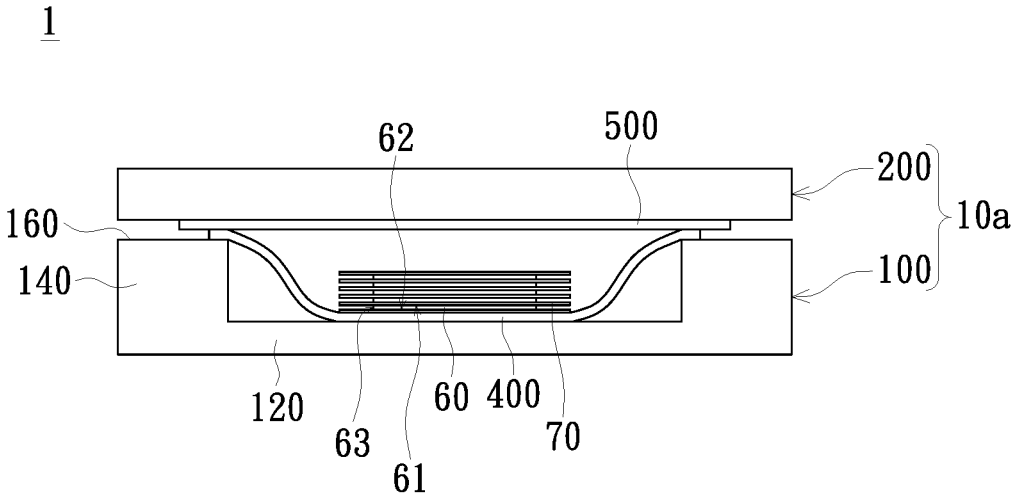
FIG. 8 is a schematic sectional view of a mask carrying system according to an embodiment of the present invention.

The mask packages 10, 10*a*, 10*b* described above are adapted to package masks, and users can flexibly choose mask packages of different embodiments of the present invention according to different requirements, such as sizes and thicknesses of the masks and number of the masks. The present invention also provides a mask carrying system. FIG. 8 is a schematic sectional view of a mask carrying system according to an embodiment of the present invention. As shown in FIG. 8, the mask carrying system 1 comprises a mask package 10*a*, at least one mask 60 and a paper material 70. In a preferred embodiment of the present invention, the mask 60 is a substantially rectangular sheet with a first surface 61 and a second surface 62 opposite to the first surface 61, and is preferably a fine metal mask.

The mask 60 can be placed on the first buffer 400 and then disposed in the accommodating space 180 of the package body 100. The mask 60 has a third length L3 and a fourth length L4, and the third length L3 is greater than the fourth length L4 and less than the second length L2, and the fourth length L4 is less than the second width W2. In a preferred embodiment of the present invention, the second length L2 is 110% to 130% of the third length L3, and the second width W2 is 110% to 120% of the fourth length L4. The third length L3 can be, for example, 300 mm to 1500 mm, and the fourth length L4 can be as small as, for example, 100 mm, and as large as 600 mm. In several embodiments of the present invention, the thickness of the mask 60 can be between 10 μm and 200 μm.

A relationship among the mask 60, the first buffer 400 and the accommodating space 180 can be referred to FIG. 4. As shown in FIG. 4, the mask 60 can be placed on the first buffer 400 in such a way that edges with the third lengths L3 correspond to edges with the first lengths L1 and edges with the second lengths L2, and edges with the fourth lengths L4 correspond to edges with the first widths W1 and edges with the second widths W2, and is disposed in the package body 100. As mentioned above, the first buffer 400 can enter the accommodating space 180 by the weight of the mask 60; however, it is not limited thereto. For example, the first buffer 400 can be disposed in the accommodating space 180 first, and then the mask 60 can be disposed on the first buffer 400. In a preferred embodiment of the present invention, the first buffer 400 is lined between the mask 60 and the package body 100. In other words, the mask 60 is supported by the first buffer 400, and side edges 63 of the mask 60 are preferably surrounded by the first buffer 400.

The paper material 70 is disposed on the first surface 61 and the second surface 62 of the mask 60. In an embodiment of the present invention, the paper material 70 can be, for example, air-laid paper with dust-avoiding and antistatic functions, etc. and an area of the paper material is preferably greater than an area of the first surface 61 and an area of the second surface 62 of the mask 60. When a plurality of masks 60 are disposed in the accommodating space 180 in an overlapped manner, the paper material 70 can avoid friction between the first surface 61 and the second surface 62 caused by relative movement between the masks 60. In an embodiment of the present invention, when the mask carrying system 1 comprises a plurality of masks 60, a plurality of paper materials 70 are overlapped with the plurality of masks 60. In addition, in several embodiments of the present invention, a plurality of paper materials 70 can be further disposed on the uppermost mask 60 (i.e., the mask 60 closest to the cover body 200).

The mask packages of the mask carrying systems in different embodiments of the present invention can be different. For example, when the third length L3 of the mask 60 does not exceed 1200 mm and the fourth length L4 is less than 100 mm, the mask 60 can be packaged and carried by, for example, the mask packages 10 and 10*a*; and when the third length L3 of the mask 60 exceeds 1200 mm and the fourth length L4 exceeds 100 mm, the mask 60 can be packaged and carried by, for example, the mask package 10*b* with the side edge reinforcing structure. when the number of masks 60 is large or an overlapping thickness is large, the masks 60 can be packaged and carried by, for example, the mask packages 10 and 10*b*; and when the number of masks 60 is small or the overlapping thickness is small, for example, the masks 60 can be packaged and carried by, for example, the mask package 10*a* or the mask package 10*b* in combination with the second buffer layer 500. The overlapping thickness may be large since the total number of masks 60 or the thickness of the mask 60 itself is large, while the overlapping thickness may be small since the number of masks 60 or the thickness of the mask 60 itself is small (for example, less than 30 μm). In a preferred embodiment of the present invention, there is a distance between the uppermost mask 60 and the cover body 200.

Figure 9:
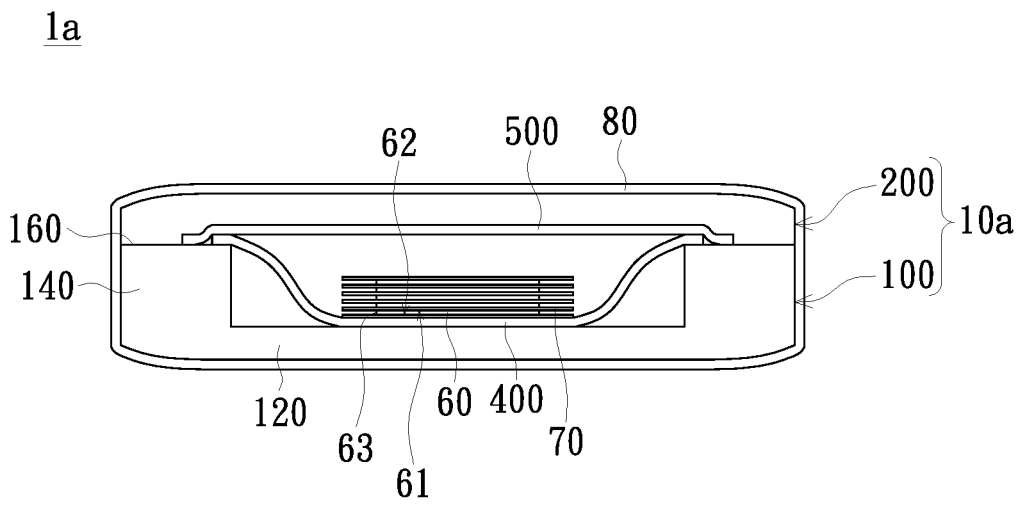
FIG. 9 is a schematic sectional view of a mask carrying system according to another embodiment of the present invention.

FIG. 9 is a schematic sectional view of a mask carrying system according to another embodiment of the present invention. This embodiment differs from the previous embodiment in that the mask carrying system 1*a* further includes an envelope 80, and the mask package 10*a* is disposed in the envelope 80. The envelope 80 can coat the mask package 10*a* through a step such as vacuum packaging. Under vacuum packaging, the cover body 200 and the package body 100 can be further tightly sealed to seal the accommodating space 180. FIG. 9 only takes the mask package 10*a* as an example. However, it can be known that the mask package such as the mask packages 10 and 10*b* of the embodiments of the present invention can be further vacuum-packaged with the envelope 80, and the mask carrying system can further include the envelope 80. According to the ISTA-1A standard, the mask package, such as the mask package 1*a*, is allowed to fall naturally at a height of 76 cm, each of six surfaces of the mask package is allowed to fall to the ground for 5 times, and then the masks are observed. Therefore, it is verified that the mask package of the embodiment of the present invention can provide a good effect of protection. All the masks in the mask carrying system remain intact and have no damage after the tests.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A mask package, comprising:

a package body having a bottom and a side wall, wherein the side wall has a top; the side wall is connected with the bottom, the top is located on a side opposite to a side where the side wall is connected with the bottom, and the side wall surrounds the bottom to form an accommodating space;

a cover body disposed on the top of the side wall and masking the accommodating space;

a first buffer having a first length and a first width, the first buffer being disposed between the package body and the cover body; and at least one paper material disposed in the accommodating space;

wherein the accommodating space has a second length and a second width, the second length is less than the first length and the second width is less than the first width.

2. The mask package as claimed in claim 1, wherein the first length is 110% to 130% of the second length, and the first width is 110% to 120% of the second width.

3. The mask package as claimed in claim 1, wherein the accommodating space has a depth, the package body has a height with a height direction parallel to a depth direction of the accommodating space, and the depth is 20% to 50% of the height.

4. The mask package as claimed in claim 1, wherein the first buffer is a sheet and is disposed in the accommodating space, and a periphery of the sheet further extends out of the accommodating space and is disposed on the top of the side wall.

5. The mask package as claimed in claim 1, wherein the first buffer has a thickness, the accommodating space has a depth, and the thickness is 1% to 10% of the depth of the accommodating space.

6. The mask package as claimed in claim 1, wherein the mask package further comprises a second buffer disposed between the first buffer and the cover body.

7. The mask package as claimed in claim 1, wherein the cover body is further connected with the package body and a pivot part is formed between the cover body and the package body, and the cover body is adapted to rotate relative to the package body with the pivot part as an axis.

8. A mask carrying system, comprising:

a mask package comprising:

a package body having a bottom and a side wall, wherein the side wall has a top; the side wall is connected with the bottom, the top is located on a side opposite to a side where the side wall is connected with the bottom, and the side wall surrounds the bottom to form an accommodating space; wherein the accommodating space has a depth;

a cover body disposed on the top of the side wall and masking the accommodating space; and a first buffer having a first length and a first width, the first buffer being disposed between the package body and the cover body;

wherein the accommodating space has a second length and a second width, the second length is less than the first length and the second width is less than the first width;

at least one mask having a first surface and a second surface opposite to the first surface, the at least one mask being disposed on the first buffer and located in the accommodating space; wherein the at least one mask has a thickness; and at least one paper material disposed on the at least one mask; wherein the at least one paper material has a thickness;

wherein each of the at least one mask further has a third length and a fourth length, the third length is less than the second length, and the fourth length is less than the second width; wherein a sum of the thickness of the at least one mask and the thickness of the at least one paper material is smaller than the depth of the accommodating space.

9. The mask carrying system as claimed in claim 8, further comprising a plurality of paper materials disposed on the first surface and the second surface of the at least one mask.

10. The mask carrying system as claimed in claim 9, further comprising a plurality of masks disposed in the accommodating space in an overlapped manner, wherein the plurality of paper materials are further overlapped with the plurality of masks, and each of the paper materials is located between two adjacent masks of the plurality of masks.

11. The mask carrying system as claimed in claim 8, wherein the second length is 110% to 130% of the third length, and the second width is 110% to 120% of the fourth length.

12. The mask carrying system as claimed in claim 8, wherein the first buffer is further disposed in the accommodating space and surrounds at least one side edge of the at least one mask.

13. The mask carrying system as claimed in claim 8, further comprising an envelope, wherein the mask package is disposed in the envelope, and the envelope coats the mask package in a vacuum manner and seals the accommodating space.

* * * * *